US012716605B2

(12) United States Patent
Beitelmal et al.

(10) Patent No.: US 12,716,605 B2
(45) Date of Patent: Aug. 25, 2026

(54) MANAGEMENT AND COMMUNICATION SYSTEM FOR NON-CENTRALIZED AIR CONDITIONERS

(71) Applicant: Qatar Foundation for Education, Science and Community Development, Doha (QA)

(72) Inventors: Abdlmonem Hasan Beitelmal, Doha (QA); Mohammed Ali Ayoub, Doha (QA); Ali Yaseen M E Elrayyah, Doha (QA)

(73) Assignee: HAMAD BIN KHALIFA UNIVERSITY, Doha (QA)

( * ) Notice: Subject to any disclaimer, the term of this patent is extended or adjusted under 35 U.S.C. 154(b) by 399 days.

(21) Appl. No.: 18/243,236

(22) Filed: Sep. 7, 2023

(65) Prior Publication Data

US 2024/0077225 A1 Mar. 7, 2024

Related U.S. Application Data

(60) Provisional application No. 63/404,270, filed on Sep. 7, 2022.

(51) Int. Cl.

| | |
|---|---|
| ***F24F 11/56*** | (2018.01) |
| *F24F 110/10* | (2018.01) |
| *F24F 110/20* | (2018.01) |

(52) U.S. Cl.

CPC ..... *F24F 11/56* (2018.01); *F24F 2110/10* (2018.01); *F24F 2110/20* (2018.01)

(58) Field of Classification Search

CPC .... F24F 11/56; F24F 2110/10; F24F 2110/20; F24F 11/58; F24F 11/30; F24F 11/46

See application file for complete search history.

(56) References Cited

U.S. PATENT DOCUMENTS

| | | | | |
|---|---|---|---|---|
| 10,724,758 | B2 | 7/2020 | Beitelmal | |
| 2004/0189485 | A1* | 9/2004 | Wang | G08C 23/04 340/5.1 |

(Continued)

OTHER PUBLICATIONS

Intesis by HMS Networks; "Universal IR Air Conditioner to Home Automation Interface"; https://www.intesis.com/products/ac-interfaces/universal-gateway/universal-ascii-wifi-ac-is-ir-wmp-1; (3 pages).

(Continued)

*Primary Examiner* — Alicia M. Choi

(74) *Attorney, Agent, or Firm* — K&L Gates LLP

(57) ABSTRACT

A communication system for an operation of an HVAC unit for a target space includes a thermostat, a communication hub, and a relay. The communication hub is configured to receive a user desired set point value from a remote control device and transmit the user desired set point value to the thermostat. The user desired set point value is for an operation of the HVAC unit. The relay includes a shielding unit and a transmitter. The shielding unit is configured to block a signal from the remote control device to reach the HVAC unit. The signal blocked by the shielding unit includes the user desired set point value. The thermostat is configured to receive the user desired set point value, adjust the user desired set point value based on measured temperature and/or humidity for the target space, and transmit the adjusted user desired set point value to the communication hub.

18 Claims, 3 Drawing Sheets

(56) References Cited

U.S. PATENT DOCUMENTS

| | | | | |
|---|---|---|---|---|
| 2008/0073440 | A1* | 3/2008 | Butler | F24F 11/58 236/91 R |
| 2018/0156487 | A1* | 6/2018 | Beitelmal | F24F 11/63 |
| 2019/0178516 | A1* | 6/2019 | Lau | F24F 11/37 |
| 2019/0257545 | A1* | 8/2019 | Ko | F24F 11/56 |
| 2019/0377374 | A1* | 12/2019 | Hoffman | F24F 11/56 |
| 2020/0370774 | A1* | 11/2020 | Jones | F24F 11/56 |
| 2022/0316740 | A1* | 10/2022 | Thibault | G05B 19/042 |

OTHER PUBLICATIONS

BuddyC; "IR Controller for Air Conditioner"; Nov. 2015; https://www.hackster.io/BuddyC/ir-controller-for-air-conditioner-5bd0a2; (13 pages).

Aqara; "Air Conditioning Controller Hub"; https://www.aqara.com/en/product/radiator-thermostat-e1/; (12 pages).

* cited by examiner

MANAGEMENT AND COMMUNICATION SYSTEM FOR NON-CENTRALIZED AIR CONDITIONERS

PRIORITY CLAIM

The present application claims priority to and the benefit of U.S. Provisional Patent Applications No. 63/404,270, filed on Sep. 7, 2022, the entirety of which is incorporated herein by reference.

BACKGROUND

Many commercial and residential buildings utilize air conditioning system such as centralized HVAC systems and/or non-centralized split air conditioning units to maintain the temperature of the building or the temperature of particular zones in the building. Within the HVAC system, a thermostat is a component that senses the temperature of the heating and/or cooling system in order to maintain the temperature of the system at a desired set point. The thermostat may exert control by switching the heating or cooling systems on or off in order to maintain the temperature.

Thermostat technology has advanced from mechanical thermostats to electrical and analog thermostats to digital electronic thermostats. With further advances in technology, programmable and smart thermostats are available for commercial and residential building automation to control the heating and/or air conditioning. Such thermostats may use a default program or a user-customized program to provide an energy savings. However, there is a constant drive to achieve improved efficiency of split AC systems, resulting in cost savings and energy savings. Thus, a management and communication system for non-centralized AC is desired.

SUMMARY

According to one non-limiting aspect of the present disclosure, an exemplary embodiment of a communication system for an operation of an HVAC unit for a target space is provided. In one embodiment, the communication system includes a thermostat, a communication hub, and a relay. The communication hub is configured to receive a user desired set point value from a remote control device and transmit the user desired set point value to the thermostat. The user desired set point value is for an operation of the HVAC unit. The relay includes a shielding unit and a transmitter. The shielding unit is configured to block a signal from the remote control device to reach the HVAC unit. The signal blocked by the shielding unit includes the user desired set point value. The transmitter is configured to transmit a command of the communication hub to the HVAC unit. The thermostat is configured to receive the user desired set point value, adjust the user desired set point value based on measured temperature and/or measured humidity for the target space, and transmit the adjusted user desired set point value to the communication hub.

Additional features and advantages are described herein, and will be apparent from the following Detailed Description and the Figures.

BRIEF DESCRIPTION OF THE FIGS

Features and advantages of the present disclosure, including a communication system for non-centralized AC such as split air conditioning units, described herein may be better understood by reference to the accompanying drawings in which.

Figure 1:
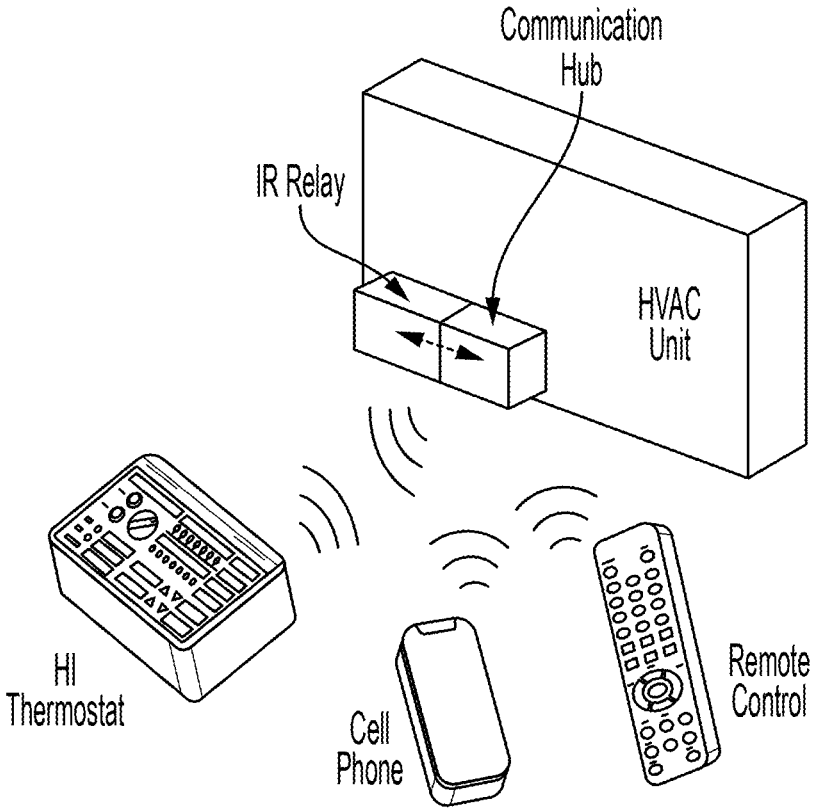
FIG. 1 illustrates a schematic diagram of a communication system according to an embodiment of the present disclosure.

The reader will appreciate the foregoing details, as well as others, upon considering the following detailed description of certain non-limiting embodiments of the present disclosure.

DETAILED DESCRIPTION

The present disclosure is generally related to a communication system for non-centralized AC.

In this present disclosure, a communication system to interact with non-central AC systems, such as split AC systems is introduced where signals (IR, WiFi, Bluetooth etc) from home energy system, AC system controller, remote control or cell phone may be received, interpreted, and processed to send a command to the AC system.

Some example Heat Index (HI) thermostats may manage the operation of centrally managed AC system and adjust a set point based on a combined consideration of temperature and relative humidity within the cooled space. Such HI thermostats are disclosed in U.S. patent application Ser. No. 15/828,193, titled HEAT INDEX THERMOSTAT, which was filed on Nov. 30, 2017 and granted as U.S. Pat. No. 10,724,758 on Jul. 28, 2020, the disclosure of which is hereby incorporated by reference in its entirety. An object of utilizing HI thermostats may be to maintain user comfort and save energy. HI thermostats may utilize measurements from distributed sensors within the cooled space, which may measure local temperature, relative humidity, and space occupancy to determine an effective temperature set point to be applied at the AC system.

According to an embodiment of the present disclosure, the present disclosure may provide a means of interaction between the Heat Index thermostat and the split AC system by intercepting the signals sent from AC remote controller or any other control device, such as an application installed on cell phones, processing the data based on the HI thermostat protocol, and sending a final effective temperature set point command to the split AC system.

In some examples, aspects of the present disclosure may provide a means to convert non-central such as split AC systems into a managed "smart" system. Aspects of the present disclosure may also provide a way to allow an integration of the Heat Index thermostat to the split AC systems. Aspects of the present disclosure may further provide a way to integrate split AC systems into a home management system that can be centrally or remotely controlled.

For example, aspects of the present disclosure may introduce ways to optimally manage non central AC operation to maintain user comfort all the time, for example, by utilizing the signals sent from a device, such as an AC remote control or cell phone. AC systems can support communication through IR, WiFi and/or Bluetooth and can receive signals sent by a remote control or from a cell phone. The AC systems may represent the dominant power consumer in buildings and key energy input for interactive home energy management system (HEMS). The communication system and/or device may allow communications between HEMS and non-central AC systems, such as the split AC units.

According to an embodiment, aspects of the present disclosure may provide a system (hardware/software) that may receive signals of various format from an installed HI thermostat, a cell phone and/or an AC remote controller, and interpret these signals into a new temperature set point based on the management or control protocol installed in the communication hub (targeting effective or comfort temperature, energy efficiency, others). The system may process the received signals to determine the appropriate signal that needs to be sent to the AC system. The system may be configured to send the specified signals and update HEMS about the change made. The communication hub can provide AC energy consumption data to the HEMS.

FIG. 1 shows a diagram of a communication system/device according to an example of the present disclosure. In some examples, the communication system/device may include a communication hub, an IR relay, an HI thermostat, an HVAC unit, a remote control device, and/or a cell phone. In other examples, the HVAC unit, remote control device, and/or cell phone may be considered as external items that may interact with the communication system. The remote control may use an IR signal to manage the HVAC unit operation. The cell phone can use an application that may be configured to send Wi-Fi, Bluetooth or IR signals for the same purpose. In some examples, the cell phone application may be considered as a type of a remote control device. The HVAC unit can receive wireless signals in the form of IR, Wi-Fi or Bluetooth, for example, based on a manufacturer used protocol.

Figure 2:
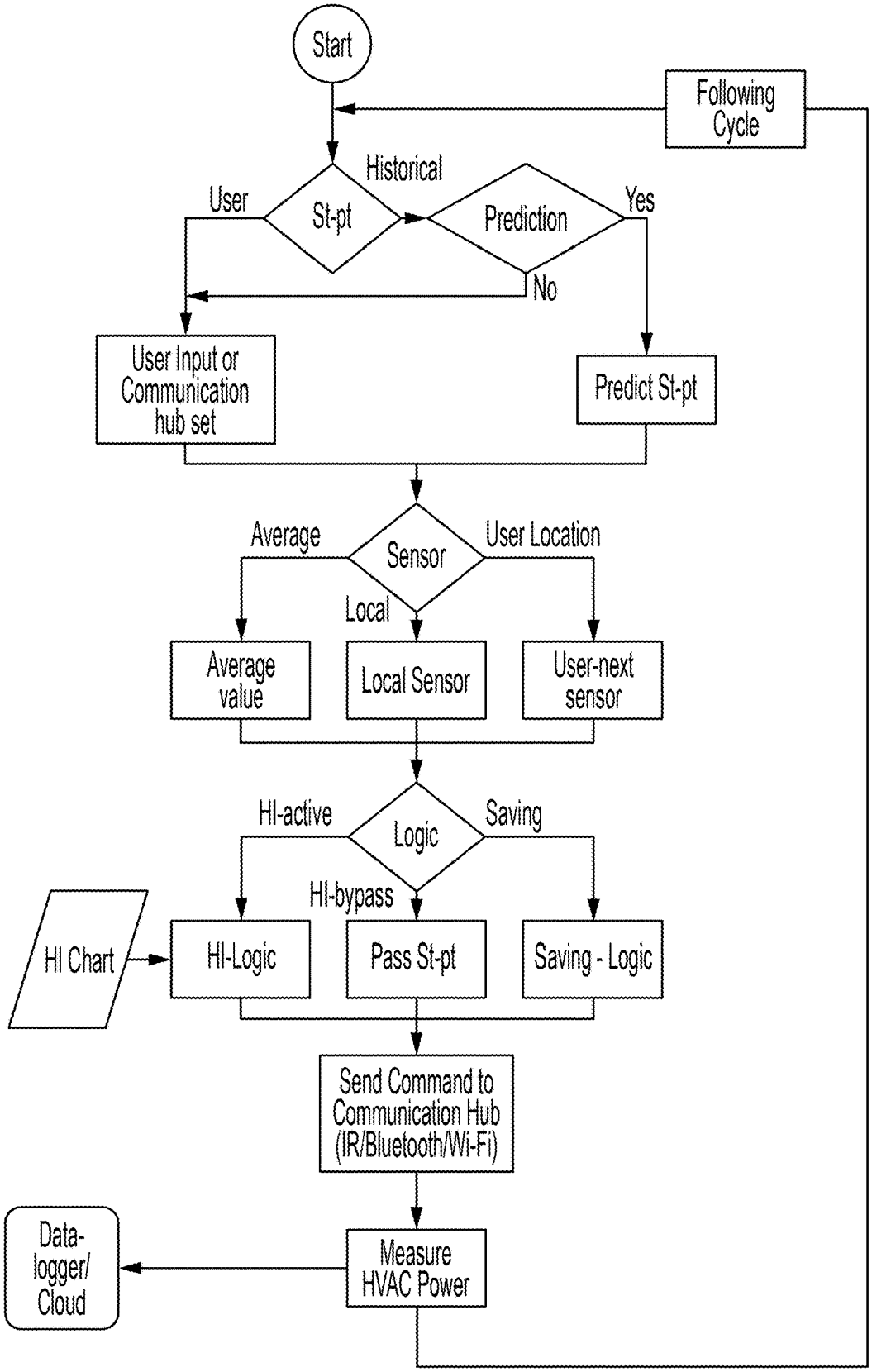
FIG. 2 illustrates a flow chart of Heat Index (HI) thermostat operation according to an embodiment of the present disclosure.

As shown in the flow chart of FIG. 2, the HI thermostat may receive a set point signal from a user and measure the temperature and relative humidity within a space to be cooled. In some examples, the set point signal from the user may be at least one of a user desired set temperature value and a user desired set humidity value. The temperature and relative humidity could be determined based on multiple measurements, for example, obtained from distributed sensors. All or at least part of these sensors may be equipped with devices to measure temperature and/or relative humidity. In some examples, other sensors, such as $CO_2$ and motion sensors, can be added to the system. In some examples, the distributed sensors may be part of the communication system. The HI thermostat may be configured to send the command for the AC operation to the communication hub, for example, through Wi-Fi or Bluetooth.

Figure 3:
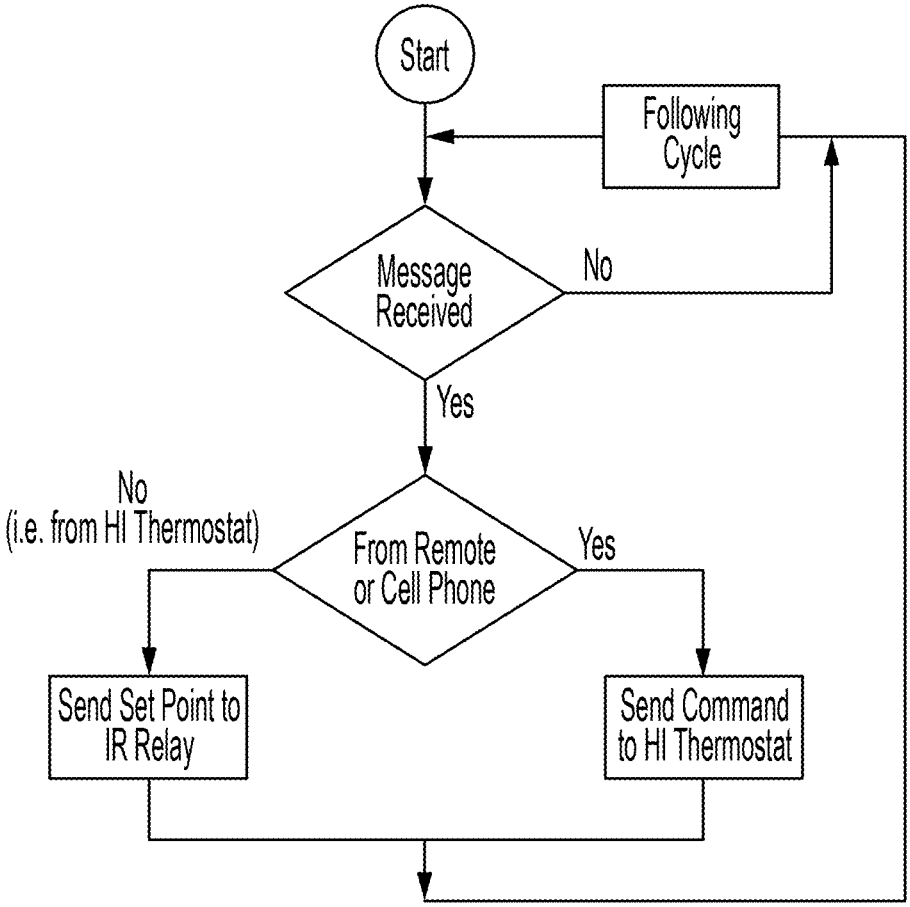
FIG. 3 illustrates a flow chart of communication hub operation according to an embodiment of the present disclosure.

The operation of the communication hub may be shown in the flow chart of FIG. 3. The communication hub can receive signals from the remote control, cell phone, and/or HI thermostat. The signal sent by the remote control or cell phone may represent a user desired set point. These values/user desired set points may be then forwarded by the communication hub to the HI thermostat to recalculate the set point to be implemented. The HI thermostat may then respond back by sending the actual value (e.g., set point) to be implemented by the AC system.

The communication hub may then send that value to the IR relay. The IR relay may include a shielding unit and an IR transmitter. The shielding unit may block the IR signals from external devices (e.g., remote control device, cell phone) to reach the IR receiver of the HVAC unit. The IR transmitter may send the command of the communication hub to the HVAC unit. By using the shielding unit of the IR relay, aspects of the present disclosure may prevent the IR signal (e.g., user desired set point) from the remote control device or user cell phone from being transmitted to the HVAC unit, thereby ensuring that (only) the set point value calculated by the HI thermostat is transmitted to the HVAC unit via the IR relay.

EMBODIMENTS

Various aspects of the subject matter described herein are set out in the following numbered embodiments:

Embodiment 1. A communication system for an operation of an HVAC unit for a target space includes a thermostat, a communication hub, and a relay. The communication hub is configured to receive a user desired set point value from a remote control device and transmit the user desired set point value to the thermostat. The user desired set point value is for an operation of the HVAC unit. The relay includes a shielding unit and a transmitter. The shielding unit is configured to block a signal from the remote control device to reach the HVAC unit. The signal blocked by the shielding unit includes the user desired set point value. The transmitter is configured to transmit a command of the communication hub to the HVAC unit. The thermostat is configured to receive the user desired set point value, adjust the user desired set point value based on measured temperature and/or measured humidity for the target space, and transmit the adjusted user desired set point value to the communication hub.

Embodiment 2. The communication system of embodiment 1, wherein the communication hub is configured to: receive the adjusted user desired set point from the thermostat, and transmit the adjusted user desired set point value to the HVAC unit.

Embodiment 3. The communication system of embodiment 2, wherein the adjusted user desired set point value is transmitted from the communication hub to the HVAC unit via the transmitter of the relay.

Embodiment 4. The communication system of embodiment 3, wherein the adjusted user desired set point value is transmitted to the HVAC unit as the command of the communication hub.

Embodiment 5. The communication system of any one of embodiments 1-4, wherein in response to receiving the adjusted user desired set point value, the HVAC unit operates according to the adjusted user desired set point value.

Embodiment 6. The communication system of any one of embodiments 1-5, wherein the measured temperature and/or measured humidity are measured from one or more sensors.

Embodiment 7. The communication system of any one of embodiments 1-6, wherein the thermostat comprises a heat index thermostat.

Embodiment 8. The communication system of any one of embodiments 1-7, wherein the relay comprises an IR relay.

Embodiment 9. The communication system of any one of embodiments 1-8, wherein the HVAC unit comprises a non-centralized air conditioner.

Embodiment 10. A method for operating an HVAC unit for a target space includes receiving, by a communication hub in a communication system, a user desired set point value from a remote control device, wherein the user desired set point value is for the operation of the HVAC unit, wherein the communication system further comprises a thermostat and a relay having a shielding unit and a transmitter; blocking, by the shielding unit of the relay, a signal from the remote control device to reach the HVAC unit, wherein the signal blocked by the shielding unit comprises the user desired set point value; transmitting, by the communication hub, the user desired set point value to the thermostat; receiving, by the thermostat, the user desired set point value; adjusting, by the thermostat, the user desired set point value based on measured temperature and/or measured humidity for the target space; and transmitting, by the thermostat, the adjusted user desired set point value to the communication hub.

Embodiment 11. The method of embodiment 10, further comprising: receiving, by the communication hub, the adjusted user desired set point from the thermostat; and transmitting, by the communication hub, the adjusted user desired set point value to the HVAC unit.

Embodiment 12. The method of embodiments 11, wherein the adjusted user desired set point value is transmitted from the communication hub to the HVAC unit via the transmitter of the relay.

Embodiment 13. The method of any one of embodiments 10-12, wherein the measured temperature and/or measured humidity are measured from one or more sensors.

Embodiment 14. The method of any one of embodiments 10-13, wherein the thermostat comprises a heat index thermostat.

Embodiment 15. The method of any one of embodiments 10-14, wherein the relay comprises an IR relay.

Embodiment 16. The method of any one of embodiments 10-15, wherein the HVAC unit comprises a non-centralized air conditioner.

Embodiment 17. A non-transitory machine readable medium storing instructions, which when executed by one or more processors, cause the one or more processors to: receive, by a communication hub in a communication system, a user desired set point value from a remote control device, wherein the user desired set point value is for the operation of the HVAC unit, wherein the communication system further comprises a thermostat and a relay having a shielding unit and a transmitter; block, by the shielding unit of the relay, a signal from the remote control device to reach the HVAC unit, wherein the signal blocked by the shielding unit comprises the user desired set point value; transmit, by the communication hub, the user desired set point value to the thermostat; receive, by the thermostat, the user desired set point value; adjust, by the thermostat, the user desired set point value based on measured temperature and/or measured humidity for the target space; and transmit, by the thermostat, the adjusted user desired set point value to the communication hub.

Embodiment 18. The non-transitory machine readable medium of embodiment 17, further storing instructions, which when executed by the one or more processors, cause the one or more processors to: receive, by the communication hub, the adjusted user desired set point from the thermostat; and transmit, by the communication hub, the adjusted user desired set point value to the HVAC unit.

Embodiment 19. The non-transitory machine readable medium of embodiment 18, wherein the adjusted user desired set point value is transmitted from the communication hub to the HVAC unit via the transmitter of the relay.

Embodiment 20. The non-transitory machine readable medium of any one of embodiments 17-19, wherein the thermostat comprises a heat index thermostat.

All of the disclosed methods and procedures described in this disclosure can be implemented, at least in part, using one or more computer programs or components. These components may be provided as a series of computer instructions on any conventional computer readable medium or machine readable medium, including volatile and non-volatile memory, such as RAM, ROM, flash memory, magnetic or optical disks, optical memory, or other storage media. The instructions may be provided as software or firmware, and may be implemented in whole or in part in hardware components such as ASICs, FPGAs, DSPs, or any other similar devices. The instructions may be configured to be executed by one or more processors or other hardware components which, when executing the series of computer instructions, perform or facilitate the performance of all or part of the disclosed methods and procedures.

As used herein, the singular forms "a", "an" and "the" are intended to include the plural forms as well, unless otherwise indicated. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Reference throughout the specification to "various embodiments," "some embodiments," "one embodiment," "an embodiment," "another embodiment," or the like, means that a particular feature, structure, or characteristic described in connection with the embodiment is included in at least one embodiment. Thus, appearances of the phrases "various embodiments," "some embodiments," "one embodiment," "an embodiment," "another embodiment," or the like, in places throughout the specification are not necessarily all referring to the same embodiment. Furthermore, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation. Such modifications and variations are intended to be included within the scope of the present invention.

One or more components may be referred to herein as "configured to," "configurable to," "operable/operative to," "adapted/adaptable," "able to," "conformable/conformed to," etc. Those skilled in the art will recognize that "configured to" can generally encompass active-state components and/or inactive-state components and/or standby-state components, unless context requires otherwise.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A communication system for an operation of an HVAC unit for a target space, wherein the HVAC unit is configured to receive control commands via infrared (IR) signals from a remote control device and lacks communication capability for remote control, the communication system comprising:

a thermostat;

a communication hub equipped with an IR relay configured to:

receive control commands over a wide-area network from a remote control device, where control commands include a user desired set point value for an operation of the HVAC unit;

transmit the user desired set point value to the thermostat, wherein the IR relay comprises a transmitter configured to transmit a command of the communication hub to the HVAC unit, wherein the IR relay is configured to intercept a signal from the remote control device, wherein the signal is addressed to the HVAC unit lacking communication capability to the remote control device, wherein the signal intercepted by the IR relay comprises the user desired set point value, wherein the thermostat is configured to:

receive the user desired set point value;

adjust the user desired set point value based on measured temperature and/or measured humidity for the target space; and transmit the adjusted user desired set point value as the command to the communication hub, wherein the thermostat receives measured temperature and/or measured humidity for a target space from distributed sensors that are not integrated into the thermostat.

2. The communication system of claim 1, wherein the communication hub is configured to:

receive the adjusted user desired set point from the thermostat; and transmit the adjusted user desired set point value to the HVAC unit.

3. The communication system of claim 2, wherein the adjusted user desired set point value is transmitted from the communication hub to the HVAC unit via the transmitter of the IR relay.

4. The communication system of claim 3, wherein the adjusted user desired set point value is transmitted to the HVAC unit as the command of the communication hub.

5. The communication system of claim 1, wherein in response to receiving the adjusted user desired set point value, the HVAC unit operates according to the adjusted user desired set point value.

6. The communication system of claim 1, wherein the measured temperature and/or measured humidity are measured from one or more sensors.

7. The communication system of claim 1, wherein the thermostat comprises a heat index thermostat.

8. The communication system of claim 1, wherein the HVAC unit comprises a non-centralized air conditioner.

9. A method for operating an HVAC unit for a target space, wherein the HVAC is configured to receive control commands via infrared (IR) signals from a remote control device and lacks communications capability for remote control, the method comprising:

receiving, by a communication hub equipped with an IR relay in a communication system over a wide-area network from a remote control device, a user desired setpoint value for the operation of the HVAC unit, wherein the communication system further comprises a thermostat and an infrared (IR) relay having a transmitter;

wherein the IR relay comprises a transmitter that is configured to intercept a signal from the remote control device to reach the HVAC unit;

wherein the signal intercepted by the IR relay comprises the user desired set point value;

transmitting, by the communication hub, the user desired set point value to the thermostat, and wherein the signal is addressed to the HVAC unit lacking communication capability to the remote control device;

receiving, by the thermostat, the user desired set point value;

adjusting, by the thermostat, the user desired set point value based on measured temperature and/or measured humidity for the target space; and transmitting, by the thermostat, the adjusted user desired set point value as a command to the communication hub;

wherein the thermostat receives the measured temperature and/or measured humidity for the target space from distributed sensors that are not integrated into the thermostat.

10. The method of claim 9, further comprising:

receiving, by the communication hub, the adjusted user desired set point from the thermostat; and transmitting, by the communication hub, the adjusted user desired set point value to the HVAC unit.

11. The method of claim 10, wherein the adjusted user desired set point value is transmitted from the communication hub to the HVAC unit via the transmitter of the IR relay.

12. The method of claim 9, wherein the measured temperature and/or measured humidity are measured from one or more sensors.

13. The method of claim 9, wherein the thermostat comprises a heat index thermostat.

14. The method of claim 9, wherein the HVAC unit comprises a non-centralized air conditioner.

15. A non-transitory machine readable medium storing instructions, which when executed by one or more processors, cause the one or more processors to:

receive, by a communication hub equipped with an infrared (IR) relay comprising a transmitter in a communication system, a user desired set point value for the operation of an HVAC unit, wherein the communication system further comprises a thermostat, and wherein the HVAC unit is configured to receive control commands via infrared (IR) signals from a remote control device and lacks communication capability for remote control;

intercept, by the IR relay, a signal from the remote control device, wherein the signal intercepted by the IR relay comprises the user desired set point value, and wherein the signal is addressed to the HVAC unit lacking communication capability to the remote control device;

transmit, by the communication hub, the user desired set point value to the thermostat; receive, by the thermostat, the user desired set point value;

adjust, by the thermostat, the user desired set point value based on measured temperature and/or measured humidity for the target space; and transmit, by the thermostat, the adjusted user desired set point value as a command to the communication hub, wherein the thermostat receives the measured temperature and/or measured humidity for the target space from distributed sensors that are not integrated into the thermostat.

16. The non-transitory machine readable medium of claim 15, further storing instructions, which when executed by the one or more processors, cause the one or more processors to:

receive, by the communication hub, the adjusted user desired set point from the thermostat; and transmit, by the communication hub, the adjusted user desired set point value to the HVAC unit.

17. The non-transitory machine readable medium of claim 16, wherein the adjusted user desired set point value is transmitted from the communication hub to the HVAC unit via the transmitter of the IR relay.

18. The non-transitory machine readable medium of claim 15, wherein the thermostat comprises a heat index thermostat.

* * * * *